US006443189B1

(12) United States Patent
Wang

(10) Patent No.: US 6,443,189 B1
(45) Date of Patent: Sep. 3, 2002

(54) VALVE ASSEMBLY FOR FILLING CONTAINERS

(75) Inventor: James J. Wang, Sugar Land, TX (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/788,609

(22) Filed: Feb. 21, 2001

(51) Int. Cl.[7] ..... B65B 1/04; B65B 3/04

(52) U.S. Cl. ..... 141/2; 141/130; 141/153; 141/156; 141/160; 141/192; 141/313

(58) Field of Search ..... 141/2, 10, 129, 141/131, 153, 156, 160, 192, 311 R, 313, 360–362, 392

(56) References Cited

U.S. PATENT DOCUMENTS

| | | | | |
|---|---|---|---|---|
| 2,013,678 A | * | 9/1935 | Winton | 137/205 |
| 3,738,080 A | | 6/1973 | Reil | 53/180 |
| 3,911,642 A | | 10/1975 | Ernstsson et al. | 53/28 |
| 4,069,153 A | | 1/1978 | Gunther | 210/64 |
| 4,121,107 A | | 10/1978 | Bachmann | 250/455 |
| 4,255,383 A | | 3/1981 | Schenck | 422/24 |
| 4,289,728 A | | 9/1981 | Peel et al. | 422/24 |
| 4,366,125 A | | 12/1982 | Kodera et al. | 422/295 |
| 4,375,145 A | | 3/1983 | Mosse et al. | 53/425 |
| 4,448,750 A | | 5/1984 | Fuesting | 422/20 |
| 4,586,549 A | * | 5/1986 | White | 141/286 |
| 4,590,740 A | | 5/1986 | Rodocker | 53/426 |
| 4,656,813 A | | 4/1987 | Baldini et al. | 53/410 |
| 4,797,255 A | | 1/1989 | Hatanaka et al. | 422/28 |
| 4,809,485 A | | 3/1989 | Nielsen | 53/503 |
| 4,848,063 A | | 7/1989 | Niske | 53/451 |
| 4,896,768 A | | 1/1990 | Anderson | 206/210 |
| 4,910,942 A | | 3/1990 | Dunn et al. | 53/425 |
| 5,047,072 A | | 9/1991 | Wertz et al. | 55/1 |
| 5,073,268 A | | 12/1991 | Saito et al. | 210/638 |
| 5,114,670 A | | 5/1992 | Duffey | 422/24 |
| 5,122,340 A | | 6/1992 | Shimamura et al. | 422/28 |
| 5,129,212 A | | 7/1992 | Duffey et al. | 53/426 |
| 5,135,714 A | | 8/1992 | Wang | 422/23 |
| 5,144,670 A | | 9/1992 | Negishi | 381/24 |
| 5,155,980 A | | 10/1992 | Mansson et al. | 53/551 |
| 5,158,816 A | | 10/1992 | Rausing | 428/35.8 |
| 5,213,759 A | | 5/1993 | Castberg et al. | 422/24 |

(List continued on next page.)

FOREIGN PATENT DOCUMENTS

| | | |
|---|---|---|
| WO | WO 92/18170 | 10/1992 |
| WO | WO 98/40273 | 9/1998 |
| WO | WO 99/08932 | 2/1999 |
| WO | WO 99/08934 | 2/1999 |
| WO | WO 00/00394 | 1/2000 |

OTHER PUBLICATIONS

Naito Shigezo et al., Method and Device for Sterilizing Packing Material, Abstract of JP 05178334, Jul. 20, 1993.

(List continued on next page.)

*Primary Examiner*—Timothy L. Maust
(74) *Attorney, Agent, or Firm*—Finnegan, Henderson, Farabow, Garrett & Dunner, L.L.P.

(57) ABSTRACT

A valve assembly for filling containers with metered quantities of materials includes a valve body having a chamber therein, the valve body having open-top and bottom ends with substantially smooth interior sidewalls defining the chamber. A valve element for opening and closing the openable bottom end of the valve body is disposed in the chamber adjacent to the openable bottom end. An actuator device, including a pair of air cylinders, provides for relative movement between a lower portion of the valve body in which the openable bottom end is disposed and the valve element in order to open and close the openable bottom end. A concentric sleeve is telescopically connected to the bottom portion of the main valve body, and is reciprocably movable in response to actuation of the air cylinders to open and close the valve.

38 Claims, 2 Drawing Sheets

U.S. PATENT DOCUMENTS

| | | | | |
|---|---|---|---|---|
| 5,326,542 | A | 7/1994 | Sizer et al. | 422/291 |
| 5,348,665 | A | 9/1994 | Schulte et al. | 210/748 |
| 5,350,568 | A | 9/1994 | Tuckner et al. | 422/300 |
| 5,428,078 | A | 6/1995 | Cohen et al. | 522/2 |
| 5,433,920 | A | 7/1995 | Sizer et al. | 422/24 |
| 5,445,793 | A | 8/1995 | Tuckner et al. | 422/28 |
| 5,489,022 | A | 2/1996 | Baker | 206/439 |
| 5,494,691 | A | 2/1996 | Sizer | 426/392 |
| 5,730,934 | A | 3/1998 | Holbert | 422/24 |
| 5,843,374 | A | 12/1998 | Sizer et al. | 422/24 |
| 6,039,922 | A | 3/2000 | Swank et al. | 422/24 |
| 6,056,918 | A | 5/2000 | Palaniappan et al. | 422/24 |
| 6,094,887 | A | 8/2000 | Swank et al. | 53/426 |
| 6,120,730 | A | 9/2000 | Palaniappan et al. | 422/28 |
| 6,183,691 | B1 | 2/2001 | Swank et al. | 422/24 |
| 6,223,791 | B1 * | 5/2001 | Arsenault et al. | 141/291 |

OTHER PUBLICATIONS

Ota Toshiyuki et al., Ozone Sterlization Method for Aqueous Solution System, Abstract of JP 06226273, Aug. 16, 1994.

Dainippon Printing, Derwent Abstract of JP 09240629, Sep. 16, 1997.

Naito Akira et al., Bathing Water Circulating and Filtering System, Abstract of JP 09285413, Nov. 4, 1997.

Hirashiki Isamu et al., Sterilizing Method and Apparatus, Abstract of JP 11226579, Aug. 24, 1999.

Fukuda Masahiko et al., Apparatus for Sterilization by Ultra Violet Radiation, Abstract of JP 11319817, Nov. 24, 1999.

Murao Kazunori et al., Process and Device for Sterilization, Abstract of JP 11342919, Dec. 14, 1999.

Kitada Takuya et al., Method and Device for Sterilization of Packaging–Material, Abstract of JP 2000142641, May 23, 2000.

* cited by examiner

VALVE ASSEMBLY FOR FILLING CONTAINERS

FIELD OF THE INVENTION

The present invention relates to a valve assembly for rapidly filling containers with metered quantities of materials. More specifically, the valve assembly of the present invention is provided for filling containers, such as flexible packages, with beverages.

DESCRIPTION OF RELATED ART

Various systems are known for filling containers, such as flexible packages, with beverages or particulate material. These systems use various types of valves, which have internal actuators for the valve elements. These actuators may be pneumatic or electrical, as desired.

However, these known valve assemblies with internal actuators present various problems. First of all, the internal actuators make it difficult to clean the interior of the valve assemblies, especially when a syrupy beverage or a citrus juice is being dispensed. Furthermore, the internal valve actuators are generally not as durable as needed, and are difficult to repair, since the entire valve must be disassembled to make such repairs.

Accordingly, there is a need in the art in filling machines for containers for durable valve assemblies which are easy to repair and easy to clean.

SUMMARY OF THE INVENTION

Accordingly, it is a primary aspect of the present invention to provide a valve assembly for use in rapidly filling containers with liquids, such as beverages, particulate materials, or the like which is durable, easy to repair, and easy to clean.

These aspects of the present invention are fulfilled by providing a valve assembly for filling containers with metered quantities of material comprising: a frame for supporting the valve assembly; a housing defining a valve body, and a chamber therein, said chamber having open top and bottom ends, substantially, and smooth interior sidewalls, said valve body having an openable bottom end in a lower portion thereof; a valve element for opening and closing the openable bottom end for accommodating or blocking, respectively, the flow of the materials through the openable bottom end; and an actuator device for imparting relative movement between the valve element and the openable bottom end to achieve open and closed positions thereof, said actuator device being disposed outside of said valve body and out of contact with materials therein.

The valve assembly includes a bracket supporting the valve body, and an annular bracket around a movable portion of the valve body for supporting the actuator device and operating the valve.

The chamber within the valve assembly is preferably an open-top chamber with a funnel-shape for containing the materials to be dispensed from the valve assembly. The open top is connectable to a filling conduit.

A disc is disposed in space relation to the bottom openable end of the chamber, and has a central bore for fixedly supporting a central pin extending from the valve element. Flow ports are provided in the disc surrounding the central aperture for accommodating liquid or material flow therethrough.

In a preferred embodiment of the present invention, the actuator device comprises an air cylinder assembly. The lower section of the valve body is provided with a concentric sleeve telescopically disposed on the main portion of the valve body, and pistons thereof are mechanically linked to the annular bracket secured to the lower portion of the valve body. Preferably, a pair of air cylinders is provided, which are symmetrically disposed on the support bracket about the valve body.

The valve assembly of the present invention, and its preferred use, is included within supply conduits of a filler unit disposed in an assembly line for rapidly filling a succession of containers, such as flexible packages.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
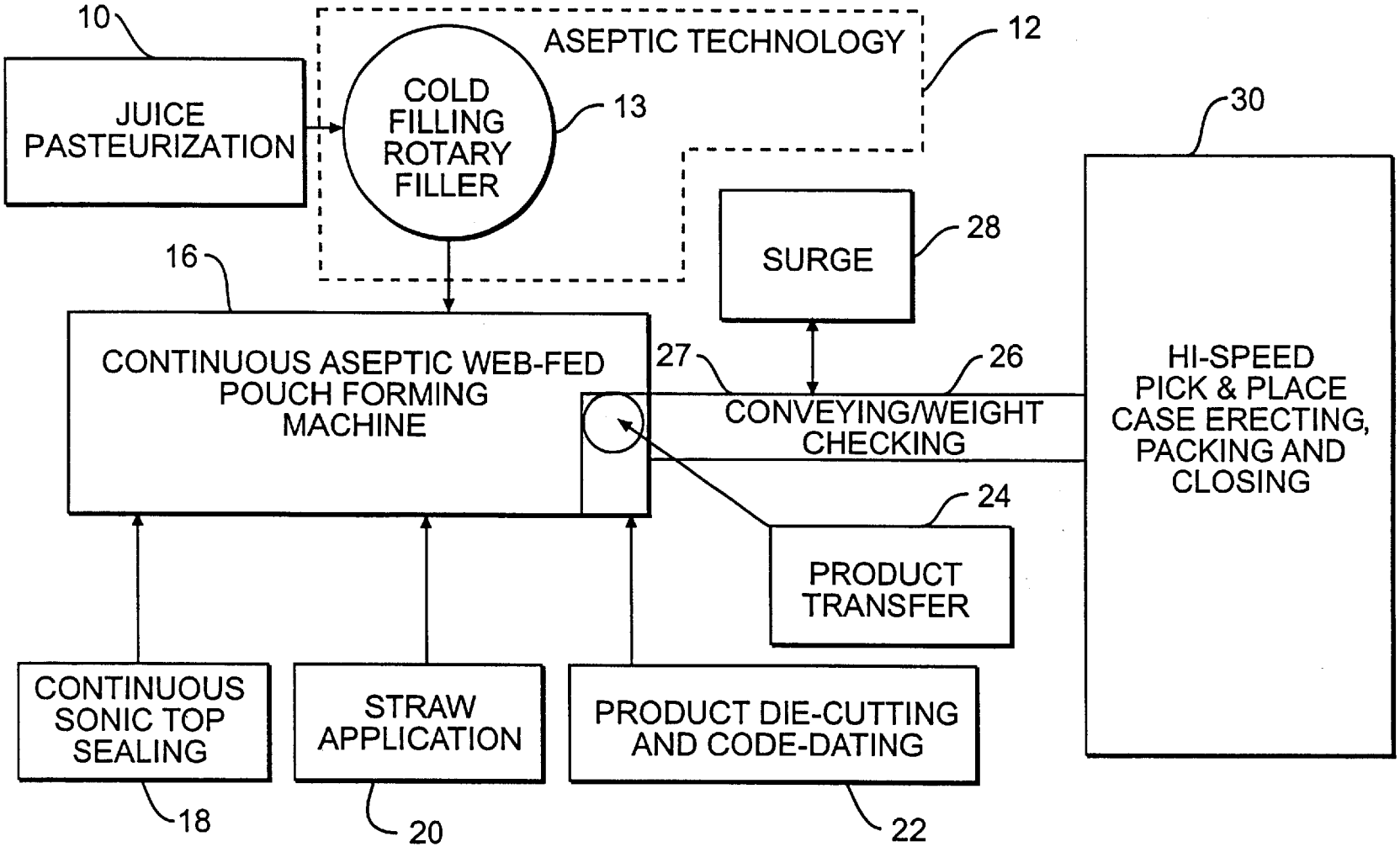
FIG. 1 is a schematic block diagram depicting an exemplary overall system configuration in which the valve assembly the present invention of may be utilized.

Referring in detail to the drawings, an exemplary method and system for rapidly filling flexible pouches with hot beverages is generally illustrated in FIG. 1. A juice pasteurization device 10 is provided for heating juice concentrate to a temperature high enough to pasteurize the concentrate and deliver it to a rotary filling station 12. The juice concentrate may vary in composition. For example, it may be a flavor concentrate combined with sugar, or may be a natural juice concentrate such as orange juice, which is used to form the final consumable beverage by mixing with a liquid such as water.

In accordance with the present invention, the flexible packages to be filled are formed in a pouch-forming machine 16, which may be any commercially available type of machine providing a pouch output of approximately 600 ppm. The pouches formed before sealing are filled with hot liquid, such as pasteurized juice. The hot juice dispensed from juice pasteurization device 10 enters the filling machine and the pouches.

Preferably, the pouch forming machine 16 receives a folded sheet of a plastic web from roll stock, and divides sections of the web into individual flexible pouches for filling from the liquid filling machine 13. Preferably, the pouch forming machine 16, in conjunction with the filling machine 13, can make and form filled packages rapidly on a continuous basis at a rate of about 600 ppm for 200 ml pouches, or 300 ppm for 330 ml pouches of various desired shapes and characteristics.

The pouches, once filled, are sealed along the fill opening thereof by a continuous sonic sealing device 20. Drinking straws may be inserted into the pouches, or attached thereto through the use of a known type of straw application device 22. Pouches from the roll stock are separated into individual containers through the use of a die-cutting device 34, which may also be provided with a printer for coding the packages with information such as the date of manufacture. Also provided at the output of the package forming and filling machinery is a rotary disc product transfer device 24 which supplies individual packages to a conveyor 27 for passing through a pouch weight checking device 26, which determines if the pouch has been properly filled. The pouches then move through a helix surge device 29 to a conveyor system 30. A high-speed pick-and-place robot 32 transfers packages from the conveyor 30.

Figure 4:
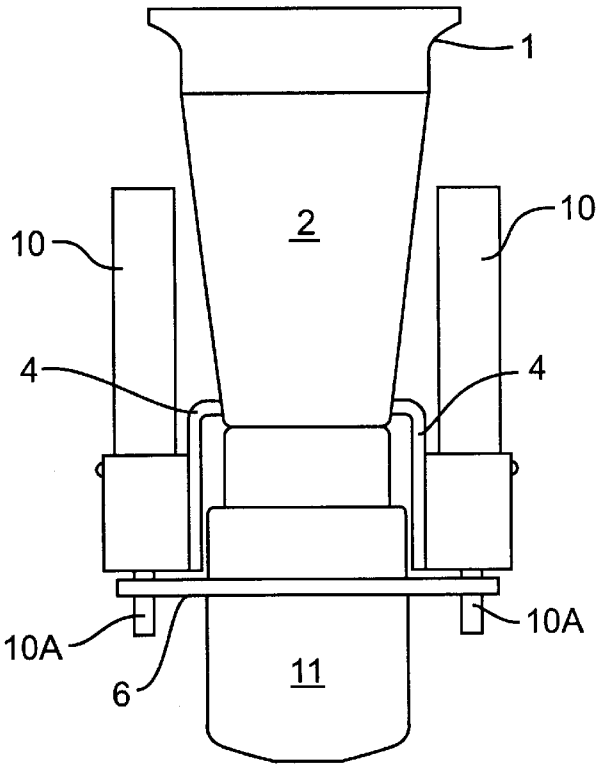
FIG. 4 is a top plan view of the valve assembly of FIG. 3.
Figure 3:
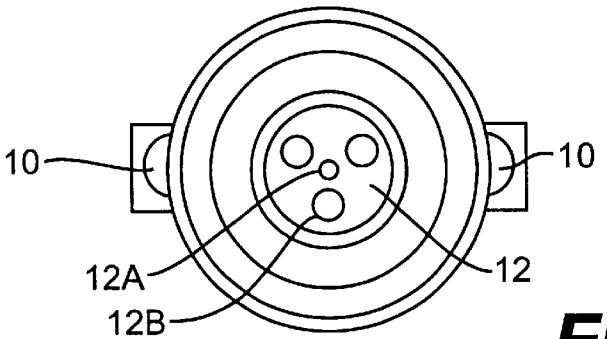
FIG. 3 is a side elevational exterior view of the valve assembly of FIG. 2.
Figure 2:
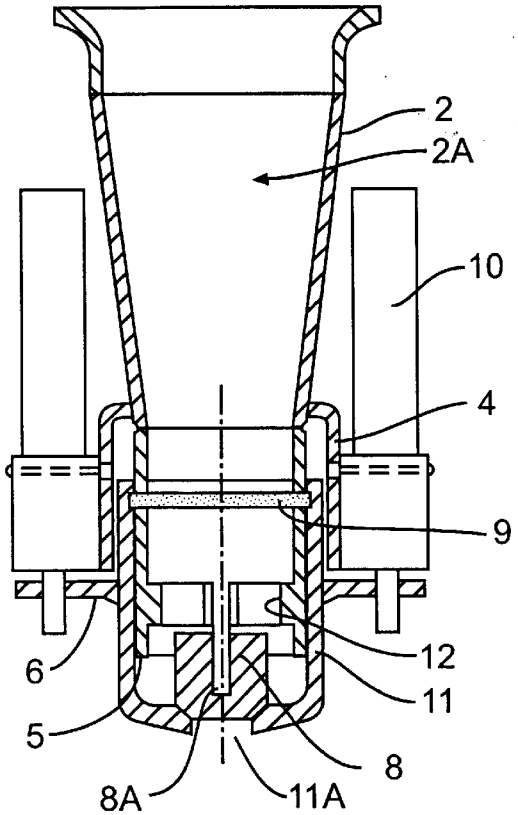
FIG. 2 is a side cross-sectional view of the valve assembly of the present invention.

Referring in detail to FIGS. 2 to 4, there is depicted a valve assembly in accordance with the present invention. The valve body 2 includes a funnel-shaped main portion defining an interior chamber 2A therein. Around the top periphery of the valve body 2 is a connecting flange 1, which is adaptable for connection to a sanitary connector of a filling unit, such as unit 13 in FIG. 1. Mounting brackets 4 are welded or suitably secured to the outside of main valve body 2 for supporting a pair of symmetrically disposed air actuator cylinders 10. An annular mounting plate 3 is provided just above bottom end 5 of valve body 2, and is connected to a concentric sleeve 11, a lower valve body portion telescopically disposed on the bottom portion of the main valve body 2. A valve element, or plug 8, is disposed within the lower portion 11 of the valve assembly for reciprocating movement therein on a pin 8A in a central opening 12A in disc 12. Disc 12 has flow ports 12B surrounding central aperture 12A. The valve element 8 opens or closes the discharge opening 11A in response to actuation of air cylinders 10 and movable piston rods 10A secured to mounting plate 6.

A viton seal 9 is provided between body 2 and sleeve 11.

In operation, the valve body 2 is normally full with the material to be dispensed. When it is required to dispense a metered quantity of the material into a container passing by from a conveyor, the air cylinders 10 are actuated to slide concentric sleeve 11 vertically downward, as illustrated in FIG. 3, to thereby unplug opening 11A with valve element 8. During dispensing of a metered quantity, the plug 8 is out of contact with opening 11A, and sleeve 11 is in its lower position. The metered quantity of material to be dispensed is controlled by the time that discharge opening 11A is open and the hydrostatic head pressure of the material in valve body 1. To quickly stop flow of material through opening 11A, air cylinders 10 retract piston rods 10A, pulling plug 8 into sealing engagement with opening 11A.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A valve assembly for filling containers with metered quantities of materials comprising:

a frame for supporting the valve assembly;

a housing defining a valve body, and a chamber therein, said chamber having open top and bottom ends, and substantially smooth interior sidewalls, said valve body having an openable bottom end in a lower portion thereof;

a valve element for opening and closing the openable bottom end for accommodating or blocking, respectively, the flow of the materials through the openable bottom end; and an actuator device for imparting relative movement between the valve element and the openable bottom end to achieve open and closed positions thereof, said actuator device being disposed outside of said valve body and out of contact with materials therein, said actuator device comprising a fluid cylinder assembly for providing said relative movement, and wherein a lower portion of the valve body is movable with respect to a main body portion thereof, and said actuator device further includes a mechanical linkage between movable piston rods of said air cylinder assembly to move the openable bottom end of the lower portion into or out of sealing engagement with said valve element.

2. The valve assembly of claim 1 wherein the frame includes a mounting bracket for supporting the valve body therein and the actuator device.

3. The valve assembly of claim 1 wherein said chamber is funnel-shaped with a top open-end diameter larger than a diameter of the bottom open end.

4. The valve assembly of claim 1 further including a disc disposed in spaced relation to the bottom openable end of the chamber, said disc having a central bore for fixedly supporting a central pin extending from the valve element, and flow ports surrounding the central bore for accommodating liquid flow therethrough.

5. The valve assembly of claim 1 wherein said lower portion of the valve body is a concentric sleeve telescopically disposed on the main valve body portion, and the mechanical linkage is a bracket connected between said movable piston rods and the sleeve.

6. The valve assembly of claim 1 wherein the fluid cylinder assembly comprises a pair of cylinders symmetrically disposed with respect to the valve body on the mounting bracket.

7. The valve assembly of claim 2 wherein said lower portion of the valve body is a concentric sleeve telescopically disposed on a main valve body portion, and the mechanical linkage is a bracket connected between said movable piston rods and the sleeve.

8. The valve assembly of claim 3 wherein said lower portion of the valve body is a concentric sleeve telescopically disposed on the main valve body portion, and the mechanical linkage is a bracket connected between said movable piston rods and the sleeve.

9. The valve assembly of claim 4 wherein said lower portion of the valve body is a concentric sleeve telescopically disposed on a main valve body portion, and the mechanical linkage is a bracket connected between said piston rods and the sleeve.

10. The valve assembly of claim 6 wherein said lower portion of the valve body is a concentric sleeve telescopically disposed on the main valve body portion, and the mechanical linkage is a bracket connected between said movable piston rods and the sleeve.

11. A system for filling flexible packages with materials comprising:

a) a filler unit for supplying the material to each package, said filler unit including filler conduits with a valve assembly in communication therewith, said valve assembly including;

a frame for supporting the valve assembly;

a housing defining a valve body, and a chamber therein, said chamber having open top and bottom ends, and substantially smooth interior sidewalls, said valve body having an openable bottom end in a lower portion thereof;

a valve element for opening and closing the openable bottom end for accommodating or blocking, respectively, the flow of liquid through the openable bottom end; and an actuator device for imparting relative movement between the valve element and the openable bottom end to achieve open and closed positions thereof, said actuator device being disposed outside of said valve body and out of contact with materials therein, wherein said actuator device comprises a fluid cylinder assembly for providing said relative movement, wherein a lower portion of the valve body is movable with respect to main body portions thereof, and said actuator device further includes a mechanical linkage between movable piston rods of said air cylinder assembly to move the openable bottom end of the lower portion into or out of sealing engagement with said valve element, and b) a conveyor system for transporting the packages through a filler unit.

12. The system with the valve assembly of claim 11 wherein the frame includes a mounting bracket for supporting the valve body therein and the actuator device.

13. The system with the valve assembly of claim 11 wherein said chamber is funnel-shaped with a top open-end diameter larger than a diameter of the bottom open end.

14. The system with the valve assembly of claim 11 further including a disc disposed in spaced relation to the bottom openable end of the chamber, said disc having a central bore for fixedly supporting a central pin extending from the valve element, and flow ports surrounding the central bore for accommodating liquid flow therethrough.

15. A The system with the valve assembly of claim 11 wherein said lower portion of the valve body is a concentric sleeve telescopically disposed on the main valve body portion, and the mechanical linkage is a bracket connected between said piston rods and the sleeve.

16. The system with the valve assembly of claim 11 wherein the fluid cylinder assembly comprises a pair of cylinders symmetrically disposed with respect to the valve body on the mounting bracket.

17. The system with the valve assembly of claim 12 wherein a lower portion of the valve body is a concentric sleeve telescopically disposed on the main valve body portion, and a mechanical linkage is a bracket connected between said movable piston rods and the sleeve.

18. The system with the valve assembly of claim 13 wherein a lower section of the valve body is a concentric sleeve telescopically disposed on the valve body, and a mechanical linkage is a bracket connected between said movable piston rods and the sleeve.

19. The system with the valve assembly of claim 14 wherein a lower portion of the valve body is a concentric sleeve telescopically disposed on the main valve body portion, and a mechanical linkage is a bracket connected between said movable piston rods and the sleeve.

20. The system with the valve assembly of claim 16 wherein a lower portion of the valve body is a concentric sleeve telescopically disposed on the main valve body portion, and a mechanical linkage is a bracket connected between said movable piston rods and the sleeve.

21. The system of claim 11 wherein the materials are from a group consisting of:

liquids, citrus juices, syrup, flavor concentrates, carbonated beverages and dairy products.

22. The system of claim 11 wherein the materials are from a group consisting of:

particulate material, powders, pulp, fruit particles and sugar.

23. The system of claim 22 wherein said materials are from a group consisting of:

liquids, citrus juices, syrup, flavor concentrates, carbonated beverages and dairy products, and particulate material, such as, powders, pulp, fruit particles and sugar, or any combinations thereof.

24. A method for filling packages with materials comprising the steps of:

a) supplying the material to a filler unit, said filler unit including filler conduits with a valve assembly therein, said valve assembly including;

a frame for supporting the valve assembly;

a housing defining a valve body, and a chamber therein, said chamber having open top and bottom ends, and substantially smooth interior sidewalls, said valve body having an openable bottom end in a lower portion thereof;

a valve element for opening and closing the openable bottom end for accommodating or blocking, respectively, the flow of liquid through the openable bottom end; and an actuator device for imparting relative movement between the valve element and the openable bottom end to achieve open and closed positions thereof, said actuator device being disposed outside of said valve body and out of contact with material therein, wherein said actuator device comprises a fluid cylinder assembly for providing said relative movement, and wherein a lower portion of the valve body is movable with respect to main body portion thereof, and said actuator device further includes a mechanical linkage between movable piston rods of said air cylinder assembly to move the openable bottom end of the lower portion into or out of sealing engagement with said valve element, and b) transporting the packages through the filler unit for receiving the materials through the valve assembly.

25. The method of claim 24 wherein the frame includes a mounting bracket for supporting the valve body therein and the actuator device.

26. The method of claim 24 wherein said chamber is funnel-shaped with a top open-end diameter larger than a diameter of the bottom open end.

27. The method of claim 24 further including a disc disposed in spaced relation to the bottom openable end of the chamber, said disc having a central bore for fixedly supporting a central pin extending from the valve element, and flow ports surrounding the central bore for accommodating liquid flow therethrough.

28. The method of claim 24 wherein said lower portion of the valve body is a concentric sleeve telescopically disposed on the main valve body portion, and the mechanical linkage is a bracket connected between said piston rods and the sleeve.

29. The method of claim 24 wherein the fluid cylinder assembly comprises a pair of air cylinders symmetrically disposed with respect to the valve body on the mounting bracket.

30. The method of claim 25 wherein a lower section of the valve body is a concentric sleeve telescopically disposed on the valve body, and a mechanical linkage is a bracket connected between said movable piston rods and the sleeve.

31. The method of claim 26 wherein a lower portion of the valve body is a concentric sleeve telescopically disposed on the main valve body portion, and a mechanical linkage is a bracket connected between said movable piston rods and the sleeve.

32. The method of claim 27 wherein a lower portion of the valve body is a concentric sleeve telescopically disposed on the main valve body portion, and a mechanical linkage is a bracket connected between said movable piston rods and the sleeve.

33. The method of claim 24 wherein the materials are from a group consisting of:

liquids, citrus juices, syrup, flavor concentrates, carbonated beverages and dairy products.

34. The method of claim 24 wherein the materials are from a group consisting of:

particulate material, powders, pulp, fruit particles and sugar.

35. The method of claim 24 wherein materials are from a group consisting of:

liquids, citrus juices, syrup, flavor concentrates, carbonated beverages and diary products, and particulate material, such as, powders, pulp, fruit particles and sugar, or any combinations thereof.

36. A valve assembly for filling containers with metered quantities of materials comprising:

a frame for supporting the valve assembly;

a housing defining a valve body, and a chamber therein, said chamber having open top and bottom ends, and substantially smooth interior sidewalls, said valve body having an openable bottom end in a lower portion thereof;

a valve element for opening and closing the openable bottom end for accommodating or blocking, respectively, the flow of the materials through the openable bottom end;

an actuator device for imparting relative movement between the valve element and the openable bottom end to achieve open and closed positions thereof, said actuator device being disposed outside of said valve body and out of contact with materials therein; and a disc disposed in spaced relation to the bottom openable end of the chamber, said disc having a central bore for fixedly supporting a central pin extending from the valve element, and flow ports surrounding the central bore for accommodating liquid flow therethrough.

37. A system for filling flexible packages with materials comprising:

a) a filler unit for supplying the material to each package, said filler unit including filler conduits with a valve assembly in communication therewith, said valve assembly including;

a frame for supporting the valve assembly;

a housing defining a valve body, and a chamber therein, said chamber having open top and bottom ends, and substantially smooth interior sidewalls, said valve body having an openable bottom end in a lower portion thereof;

a valve element for opening and closing the openable bottom end for accommodating or blocking, respectively, the flow of liquid through the openable bottom end; and an actuator device for imparting relative movement between the valve element and the openable bottom end to achieve open and closed positions thereof, said actuator device being disposed outside of said valve body and out of contact with materials therein; and a disc disposed in spaced relation to the bottom openable end of the chamber, said disc having a central bore for fixedly supporting a central pin extending from the valve element, and flow ports surrounding the central bore for accommodating liquid flow therethrough; and b) a conveyor system for transporting the packages through a filler unit.

38. A method for filling packages with material comprising the steps of:

a) supplying the material to a filler unit, said filler unit including filler conduits with a valve assembly therein, said valve assembly including;

a frame for supporting the valve assembly;

a housing defining a valve body, and a chamber therein, said chamber having open top and bottom ends, and substantially smooth interior sidewalls, said valve body having an openable bottom end in a lower portion thereof;

a valve element for opening and closing the openable bottom end for accommodating or blocking, respectively, the flow of liquid through the openable bottom end; and an actuator device for imparting relative movement between the valve element and the openable bottom end to achieve open and closed positions thereof, said actuator device being disposed outside of said valve body and out of contact with material therein; and a disc disposed in spaced relation to the bottom openable end of the chamber, said disc having a central bore for fixedly supporting a central pin extending from the valve element, and flow ports surrounding the central bore for accommodating liquid flow therethrough; and b) transporting the packages through the filler unit for receiving the materials through the valve assembly.

* * * * *

UNITED STATES PATENT AND TRADEMARK OFFICE

CERTIFICATE OF CORRECTION

PATENT NO. : 6,443,189 B1
DATED : September 3, 2002
INVENTOR(S) : James J. Wang

It is certified that error appears in the above-identified patent and that said Letters Patent is hereby corrected as shown below:

Column 5,
Line 39, before "The" delete "A".

Column 7,
Line 23, after "wherein" insert -- said --.
Line 26, "diary" should read -- dairy --.

Signed and Sealed this

Eleventh Day of March, 2003

JAMES E. ROGAN
*Director of the United States Patent and Trademark Office*